United States Patent [19]

Smith et al.

[11] Patent Number: 5,005,649

[45] Date of Patent: Apr. 9, 1991

[54] MULTIPLE FRACTURE PRODUCTION DEVICE AND METHOD

[75] Inventors: John C. Smith, Pasadena; William O. Jacobson, San Diego, both of Calif.

[73] Assignee: Union Oil Company of California, Los Angeles, Calif.

[21] Appl. No.: 486,144

[22] Filed: Feb. 28, 1990

[51] Int. Cl.[5] ..... E21B 43/26; E21B 43/267

[52] U.S. Cl. ..... 166/308; 166/177; 166/317

[58] Field of Search ..... 166/308, 177, 317, 271, 166/281, 280, 283, 259

[56] References Cited

U.S. PATENT DOCUMENTS

| | | | |
|---|---|---|---|
| 3,087,551 | 4/1963 | Kerver | 166/317 |
| 3,602,311 | 8/1971 | Whitsitt | 166/308 |
| 3,743,017 | 7/1973 | Fast et al. | 166/308 X |
| 3,980,134 | 9/1976 | Amancharla | 166/317 X |
| 4,391,337 | 7/1983 | Ford et al. | 175/4.6 |
| 4,548,252 | 10/1985 | Stowe et al. | 166/299 |
| 4,617,997 | 10/1986 | Jennings, Jr. | 166/308 X |
| 4,683,951 | 8/1987 | Pathak | 166/271 |
| 4,718,490 | 1/1988 | Uhri | 166/281 |
| 4,741,401 | 5/1988 | Walles et al. | 166/300 |

OTHER PUBLICATIONS

"Hydraulic Fracturing", by G. C. Howard & C. R. Fast, 1970, American Institute of Mining, Metallurgical & Petroleum Engineers, Chapters 7 & 8, pp. 91–136.

"Multiple Fracturing of Boreholes by Using Tailored--Pulse Loading," by R. P. Swift and A. S. Kusubov, Society of Petroleum Engineers Journal, Dec. 1982, pp. 923–932.

*Primary Examiner*—Stephen J. Novosad

*Attorney, Agent, or Firm*—Gregory F. Wirzbicki; William O. Jacobson

[57] ABSTRACT

The present invention achieves a more reliable multiple fracturing of a subterranean formation by inserting high pressure tubing and isolating a portion of the wellbore (including the formation of interest and an end portion of the tubing) with packers. Near the end of the tubing is a closable end and a rupturable plenum holding a sufficient volume of pressurized gas to produce a pressure ramp sufficient to cause multiple fractures in the isolated portion when the plenum is ruptured. The closable end is closed after filling the isolated portion with a fracture fluid and proppant. The rupturable means is provided by at least one rupture disc. Multiple discs can provide a step wise pressure rise ramp to tailor the multiple fracture producing pulse. By providing a known volume of pressurized gas and rupture discs, a controlled pulse loading can be achieved. Like the propellant driven pulse loading techniques, it achieves a pressure ramp, but the present invention avoids the damage potential and improves the reliability of creating multiple fractures. The present invention can also be easily modified for alternative applications and is also expected to be safe, tolerant of off-design conditions, cost effective, and efficient.

18 Claims, 1 Drawing Sheet

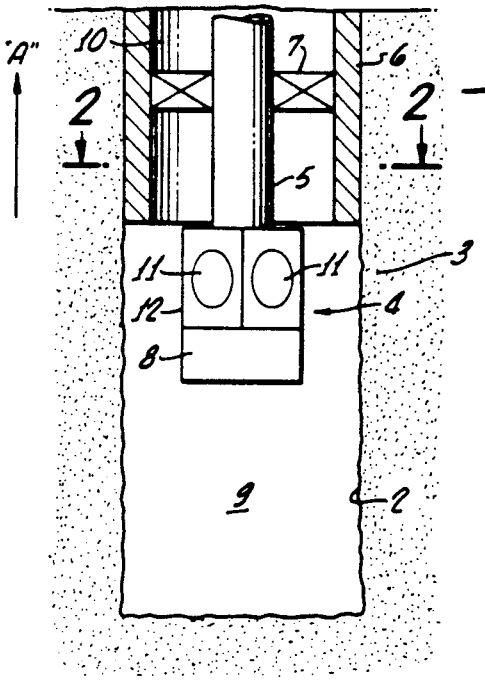
FIG. 1.
FIG. 2.
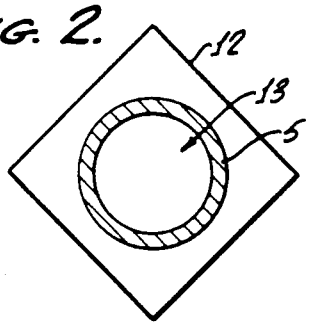
FIG. 3.
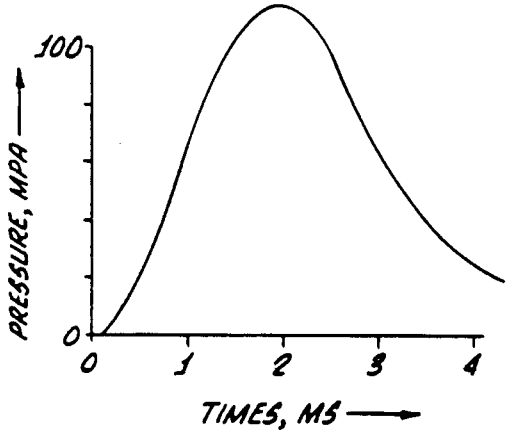
FIG. 4.
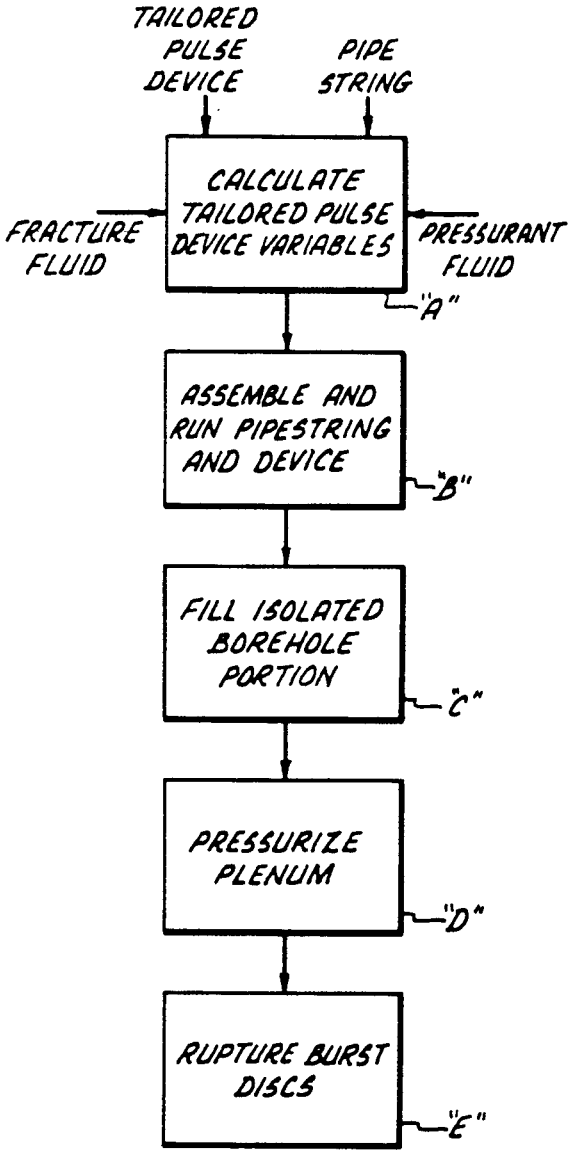

MULTIPLE FRACTURE PRODUCTION DEVICE AND METHOD

FIELD OF THE INVENTION

This invention generally relates to the fluid pressure (i.e., hydraulic) fracturing of subterranean formations. More specifically, the invention is concerned with providing a tailored pulse means to economically and reliably increase the number of fractures produced during hydraulic fracturing.

BACKGROUND OF THE INVENTION

In producing or injecting hydrocarbons or other fluids within a subterranean formation from a well borehole, it is often necessary to treat the formation to increase its productivity. One well known technique for increasing productivity is to hydraulically fracture the formation, e.g., pumping a fracturing fluid down a wellbore and into the formation at a pressure above which the formation parts, which creates one or more channels (i.e., failures or fractures) in the formation through which fluids can easily flow. In some of these methods, a proppant (e.g., sand) is included with the fracturing fluid to keep the fracture open after the formation fracturing pressure is reduced (and bedding planes tend to come together).

A single fracture (e.g., a single bedding plane separation emanating in both directions from a well borehole) would be normally produced by hydraulic fracturing methods. The single fracture is at a weak discontinuity (e.g., between sedimentary layers) or perpendicular to the direction of the principal stress. These single fractures increase productivity, but generally do not interconnect with other fractures to reach portions of the formation away from the single plane, leaving large, potentially productive zones unconnected to the borehole. If a reliable method of hydraulic fracturing could produce a multiplicity of deep fractures in directions radiating from the borehole, a significant increase in hydrocarbon fluid production may be possible.

In a common process, the fracture fluid is supplied from surface equipment, e.g., high pressure pumps, through high pressure tubing to the formation of interest, which may be isolated by packers. The high pressure tubing avoids excessive pressures/damage to casing, cement or formation at areas other than the formation of interest. When the surface pumps are actuated, the pressure increases at a rate determined by the pumping equipment. Once the initial fracture is initiated, the fluid pumping must be at rates sufficient to open and extend the fracture (and emplace proppant, if used). Because of slow loading rates and low pressures, usually only one fracture is formed during this type of hydraulic fracturing process.

Fracture fluids, such as high viscosity liquids, can be selected to decrease fluid (and pressure) loss at the fracture(s). However, high viscosity results in other problems, such as increased frictional pressure loss in the tubing. Cross-over ports and other methods have also been used to mitigate the fluid flow/pressure limitations inherent in surface pumps and tubing, but with limited success.

Another approach to these limitations on the number of fractures is to seal off initial fractures, temporarily limiting fluid and pressure loss through these fractures during the hydraulic fracturing process. This has been done by packers, entrained ball sealers, and sand plugbacks. However, these temporary blockage approaches add material costs, equipment costs, time and risk.

Another method of obtaining multiple fractures is to use an explosive charge or explosive perforation of the casing. The very rapid duration of the explosive effects cause multiple, but shallow fractures and undesirable pulverization of formation rock.

The heat and explosive nature of the charges can damage the casing, cement, or formation in areas where fractures are unwanted. Still further, the fractures created are not propped open (insufficient time to carry proppant to all fractures). Thus, quickly after the pressure decreases, the fractures may close and not form highly conductive paths from the well borehole to deep within the formation.

In addition, because of the nature of the explosion, the peak absolute pressure and loading rates may be poorly controlled. This may cause more damage (for uncontrolled high values) or an inability to open sufficient fractures (for uncontrolled low values).

A more recent method of producing a multiplicity of fractures uses an in-situ combustion process (e.g., rocket propellant and oxidizer) to generate a tailored pressure pulse. The combustion generates large volumes of gases downhole over short (e.g., up to tens of milliseconds), but not explosive time periods. The gas generation results in a rapid (but not explosive) pressure rise rate. The pressure rise rate is in between surface pumping rate limitations (generally less than 1 MPa/s) and rates from an explosive charge (generally greater than $10^7$ MPa/s).

Careful handling, however, similar to explosive handling, is needed for the propellants. Once the propellant is ignited, little control is possible. Propellant charges are also difficult to adapt to different applications.

A more economic, controlled and reliable means and method to obtain tailored pulse loading produced multiple fractures is needed. The device and method should also be capable of adapting to different applications. A minimum of effort to convert from one application to another is also desirable.

SUMMARY OF THE INVENTION

The present invention achieves a more reliable multiple fracturing by inserting high pressure tubing into a portion of the wellbore (to the fracture zone of interest) and isolating the zone with packers. At the inserted end of the tubing is a closable port and a rupturable plenum. The plenum holds a volume of pressurized fluid which produces a tailored pulse sufficient to cause multiple fractures in the isolated portion when the plenum is ruptured. The port is closed after filling the isolated portion with a fracture fluid and proppant. By providing a known volume of pressurized fluid and multiple burst discs, a more controlled pressure pulse loading can be achieved. Like the propellant driven pulse loading techniques, the present invention also produces a rapidly rising pressure pulse to open and force fracture fluid and proppant into multiple fractures, but avoids the damage potential and improves the control and reliability. The present invention is also safe and cost effective.

BRIEF DESCRIPTION OF THE DRAWINGS

FIG. 1 shows a cross sectional side view of borehole containing a tailored pulse device of the invention;

FIG. 2 shows a top cross sectional view 2—2 of a tailored pulse device shown in FIG. 1;

FIG. 3 shows a pressure-time curve of a pressure pulse produced by the tailored pulse device; and FIG. 4 shows a process flow schematic using a tailored pulse device of the invention.

In these Figures, it is to be understood that like reference numerals refer to like elements or features.

DETAILED DESCRIPTION OF THE INVENTION

FIG. 1 shows a cross-sectional view of a borehole 2 penetrating a formation of interest 3. Contained within the borehole 2 is a tailored pulse device 4 attached to one end of a pipe string or duct-like tubing 5. The borehole 2 includes a metallic casing 6 from the ground surface (not shown for clarity) above (direction of arrow "A") the formation of interest 3. The casing 6 is typically cemented to the formation 3 forming a fluid tight seal between the casing and the formation behind the casing.

The subterranean formation of interest 3 in the preferred embodiment is an oil bearing sedimentary layer. Multiple radial fractures are desired to increase the production of oil from the formation near the bottom of the well borehole 2. Without tubing and a high pressure packer 7, the strength of casing 6 limits the pressure that may be applied. Without this invention, the pipe string 5 flow area, pumping equipment capacity, fluid compressibility and permeability of the formation limit the fracture fluid flow and pressure rise rate that can be applied to the formation by pumps located at the ground surface.

The pipe string or duct 5 is composed of high strength materials, such as steel, capable of withstanding pressures typically expected to range from approximately 138 MPa (20,000 psi) to 310 MPa (45,000 psi). Lower pressures may be adequate, but still higher pressures may also be required, depending upon formation, device and fluid variables. Pressure rise rates are expected to be intermediate between prior surface pumping methods (1 MPa/sec) and explosive methods ($10^7$) MPa/sec), but are more likely between 10 MPa/sec and $10^6$ Mpa/sec), and most likely greater than $10^2$ MPa/-sec). Alternatively, the pipe string 5 may include a check valve (not shown) near the bottom end. If present, the check valve prevents upwards (direction "A") flow of fluids within the pipe string during the pressure pulse. The pipe string 5 provides a fluid conduit to the surface when valved port or closure valve 8 is open.

After running or inserting the pipe string 5 into the cased borehole 2, the high differential pressure packer 7 is expanded against the casing 6 to provide a seal. The packer 7 isolates the lower cavity or borehole portion 9. In an alternative configuration, packer 7 can include a check or other type of valve to provide a closable conduit from the cavity 9 to the upper annulus 10 between the casing 6 and high pressure pipe string 5. This alternative configuration allows fracture fluid to be introduced, partially pressurized, and flowing into the isolated cavity portion 9 prior to the rupture and pressure pulse of fluid from the drill string 5.

A fracture fluid and proppant mixture can be conducted from the surface through pipe string 5 and tailored pulse device 4 (including closure valve 8) to the isolated cavity 9. A measured amount of fracture fluid and proppant mixture can be conducted to the isolated cavity 9. After filling the isolated cavity 9 with the fracture fluid and proppant mixture, the closure valve 8 can be remotely closed. Alternatively, the closure valve 8 can be eliminated and cavity 9 can be filled prior to installation of the pipe string 5. The remote type of closure valves 8 include pressure actuated or solenoid actuated valves. A first pressurant fluid, typically a non-combustion product fracture fluid and proppant or a compressible gas, can then be introduced to the tailored pulse device 4. The pressurized fluid is contained within the tailored pulse device until rupture diaphragms or burst discs 11 attached to plenum 12 burst. Alternatively, the burst discs may be pip off valves or remotely operated high pressure valves. The preferred first pressurant fluid is cross linked gels, linear gels, foams or water, but may also be an inert gas.

An alternative embodiment provides for a stacking of tailored pulse devices 4 on a pipe string 5. This embodiment allows multiple fractures at different formations or at different levels of one formation. Each device would be isolated within one or several cavities 9 by multiple packers and isolated from each other by the separate closure valves 8. Each isolated device would contain a specific quantity of pressurant, and the pressurant in each cavities may be different. In the best mode of this embodiment, the bottom most device's burst discs could be ruptured first, the next higher closure valve closed, plenum pressurized and discs ruptured, etc. An alternative embodiment would seal or bypass ruptured devices and rupture the remaining unruptured devices.

After rupturing, continued pumping of fracture fluid is possible. This allows an extension of fractures deep into the formation. This continued pumping overcomes the limitation of prior gas generating devices which limit the depth of fracturing to the amount of propellant in the gas generating device.

A top cross sectional view 2—2 view of a tailored pulse device 4 is shown in FIG. 2. The walls of the pipe string 5 form a fluid conduit 13 extending from the surface (not shown) to the plenum 12. In an alternative embodiment, the plenum 12 may contain another rupture diaphragm at the intersection of the pipe string conduit 13 and plenum 12. Upon burst pressure being applied to this added (upstream series located) rupture diaphragm, a flow of pressurant begins into the interior of the plenum 12. The increasing flow and pressure into the plenum ruptures the downstream located burst diaphragms, creating a more rapidly increasing pressure pulse, when compared to a single stage of rupturing burst discs. The plenum location is chosen to place the burst discs 11 proximate to the formation face (see FIG. 1). When the discs 11 rupture, jets of pressurized fluid are propelled, preferably perpendicularly, into the formation face. The pressure pulse and kinetic energy of the fluids tend to create multiple fractures in the formation 3.

The rupture within the isolated cavity filled with fracture fluid produces a pressure-time result shown in FIG. 3. The preferred fracture fluid also includes suspended sand as a proppant, but bauxite and other ceramics may also be used. The peak pressures are not achieved instantaneously, as produced by a detonation of explosives, but the pressure rises rapidly. In the example shown, this rising portion of the tailored pulse reaches a peak pressure of approximately 100 MPa over a period of at least 0.5 milliseconds. Other core test results indicate a time from first pressure pulse rise to peak can be a few milliseconds and peak pressures can be as low as 13 MPa. However, more or less rapid pressure rise periods and peak pressures are possible, depending upon formation, fluid and device variables.

The type of burst disc (number and size of openings) and burst pressure can be selected to optimize the peak pressure and rise time values which maximize multiple fracture formation. Optimization of rupturing means is based upon formation information such as formation fluids, drilling muds used, well borehole damage, principle stresses, type of sediment or rock, presence (and extent) of in place fractures, and fracture fluid properties.

The process of using the tailored pulse device 4 (see FIG. 1) is shown in FIG. 4. The tailored pulse device configuration variables (e.g., amount of pressurant, size of the plenum, and number of burst diaphragms) are calculated at step "A." This calculation can be accomplished by a computer or microprocessor. The borehole dimensions, formation information, pipe string size and pressure rating, and tailored pressure pulse shape desired are some of the factors that may be used as a basis for calculating the tailored pulse configuration variables.

The tailored pulse device 4 is assembled, attached to the pipe string 5 having packer 7 (see FIG. 1), and run in the cased borehole 2 at step "B." The pipe string 5 is located so that the final burst discs are proximate and preferably perpendicular to the formation of interest where multiple fractures are desired.

The isolated portion 9 (see FIG. 1) of the borehole is filled with fracture fluid through the pipe string 5 and tailored pulse device 4 at step "C." The end closure is open to conduct the fracture fluid. A known amount of fracture fluid is introduced into the isolated portion. The known amount may be separated from other fluids within the pipe string by plugs.

An alternative configuration fills the isolated portion 9 of the borehole through annulus 10 and check valves in packer 7 (see FIG. 1). The packer check valve effectively prevents the tailored pressure pulse or fracture fluid in the isolated portion from returning to the annulus. A remotely actuated valve may also be used in place of or to supplement the check valve in the packer. A supplementary valve would allow circulation of a fracture fluid and proppant mixture during pressurization of the plenum, ensuring proper fluid distribution near the formation. In this embodiment, closure valve 8 (see FIG. 1) is not required and the end of the plenum can be a solid wall.

The valve 8 is closed and plenum 12 is pressurized with a pressurant fluid at step "D." The pressurant fluid is typically a fracture fluid, but may also be a gas, a blowing compound or a reactive mixture, or mixtures thereof. The pressurized gas may be held for a sufficient period of time to transfer any heat of compression to the formation.

Step "E" applies increasing pressure to rupture the burst discs. The burst discs may also be remotely ruptured on command. Burst discs are selected to introduce rapidly increasing amounts of the high pressure gas from the plenum 12 to the isolated cavity 9 (see FIG. 1), creating the first part of the tailored pressure pulse (see FIG. 3).

After peaking, the fracture fluid flow, added surface supplied fluid flow, and expansion of the pressurant gas creates a trailing portion of the tailored pressure pulse. The trailing pressure decline is contrasted to the sharper drop off in pressure resulting from an explosive device (i.e., no added flow and cooling of hot gases penetrating the formation). The simultaneously rupturing (i.e., parallel in time) burst discs also direct the flow of high pressure gases to the face of the formation to further initiate multiple fractures.

The invention allows the tailored pulse device to be made up or modifiable in the field. It is also easy to store, transport, inspect, and disassemble.

The size of the plenum varies depending upon the pressure peak desired and other variables. The maximum possible size of the plenum that can be used is determined by the isolated borehole size.

Still other alternative embodiments are possible. These include: more than two in a series of burst discs to further shape and control the tailored pulse (i.e., an upstream high pressure burst disc ruptures first, creating an inrush of pressurant to a second rupturable chamber, the inrush and increasing pressure simultaneously rupturing a second burst disc or discs, creating an even greater inrush of pressurant to a third set of rupturable chambers proximate to the formation to be multiple-fractured; a compartmentalized plenum and commanded rupture means in each compartment to produce a series of ruptures to the isolated cavity (i.e., plenum 12 is sectioned into separate compartments which can be isolated and ruptured independently of each other); a cross over means in the pipe string to increase flow into the isolated cavity during the trailing pressure decay portion of the tailored pulse (i.e., provide a means for pressurized fluid in the annular portion to enter the pipe string when pipe string conduit pressure has decayed below the annular pressure); the burst discs composed of porous, thermally degraded, or reactive materials (i.e., the burst disc material and pressure containment ability is affected by the downhole conditions, allowing safe above-ground handling but quick acting release of fluids downhole); and the plenum placed in a protective enclosure during surface handling and insertion, to be removed prior to rupture.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for producing a tailored fluid pressure pulse in a borehole penetrating a subterranean formation from a pipe string, the tailored fluid pressure pulse sufficient to produce multiple fractures in the formation, the method comprising:

a. running the pipe string into the borehole, wherein the pipe string comprises a fluid conduit, a packer for isolating a portion of the borehole and a rupturable plenum capable of being filled with a pressurant fluid;

b. isolating a portion of the borehole containing at least a portion of the plenum with said packer;

c. filling the isolated portion with a fracture fluid and proppant mixture;

d. pressurizing a pressurant fluid within the rupturable plenum from a pressurant fluid pressurizing source located at the surface; and e. rupturing the pressurized plenum so as to create a tailored fluid pressure pulse within the isolated portion.

2. A method for producing a fluid pressure pulse in a cavity penetrating a subsurface material from a duct, said fluid pressure pulse sufficient to produce multiple fractures in said material, said method comprising:

a. placing at least a portion of said duct within said cavity, wherein said duct comprises a fluid conduit, a means for isolating a portion of said cavity, and a rupturable first plenum containing a first fluid;

b. isolating a portion of said cavity containing at least a portion of said first plenum;

c. filling at least part of said isolated portion with a second fluid;

d. pressurizing said first fluid within said first plenum from a remote pressurizing source; and e. rupturing said first plenum so as to cause said fluid pressure pulse within the isolated portion.

3. A method for producing a pressure pulse in a borehole penetrating a subsurface formation, said pressure pulse sufficient to produce multiple fractures in said formation, said method using a duct for conducting a fluid from the surface to near said formation and a means for isolating a portion of said borehole containing a segment of said duct, at least part of said duct segment having a rupturable first plenum capable of being pressurized by a first fluid and ruptured at a pressure producing at least a portion of said pressure pulse within said isolated portion comprising:

a. placing at least a portion of said duct within said borehole;

b. isolating a portion of said borehole containing at least a portion of said first plenum;

c. filling at least part of said isolated portion with a second fluid;

d. pressurizing said first fluid within said first plenum from a remote pressurizing source; and e. rupturing said first plenum.

4. The method of claim 3 which also uses a second plenum capable of being pressurized by a third fluid and being ruptured at a pressure so as to produce at least a portion of said pressure pulse within said isolated portion, also comprising the steps of:

f. pressurizing said third fluid within said second plenum; and g. rupturing said second plenum.

5. The method of claim 4 wherein said filling is accomplished by flowing said second fluid through said duct from a location above said formation to said isolated portion.

6. The method of claim 5 wherein said plenum includes a closable port fluidly connecting said plenum to said isolated portion and said filling step also includes the steps of:

opening said closable port prior to said flowing of said second fluid; and closing said closable port after flowing said second fluid.

7. The method of claim 6 wherein said first and third fluids are generally non-reactive fluids, said second fluid is a mixture of a liquid fracture fluid and solid proppant, and said filling step distributes said proppant and fracture fluid mixture to a location near the formation.

8. The method of claim 7 wherein said rupturing step causes a tailored pressure pulse having a pressure rise portion of greater than 10 MPa/second and less than $10^6$ MPa/second.

9. The method of claim 8 wherein said tailored pulse peak occurs over a period of time greater than 0.5 milliseconds from the first indication of said pressure rise portion.

10. The method of claim 9 wherein said filling step comprises:

flowing said second fluid through said duct from a location above said formation to said isolated portion; and pressurizing said second fluid within said isolated portion from a location above said formation.

11. A multiple fracture producing apparatus for generating a fracture fluid pressure pulse and fracture fluid flow within a borehole penetrating a subsurface formation comprising:

tubing capable of being located within said borehole and forming an annular-like space between said tubing and said borehole;

a plenum for containing a pressurized fluid, said plenum attached to said tubing;

means for isolating a portion of said borehole containing at least a part of said plenum from fluid communication with remaining portions; and means for rupturing said plenum at relatively high pressure, so as to allow at least a portion of said pressurized fluid within to escape into said borehole containing a fracture fluid and generate said fluid pressure pulse and fracture fluid flow.

12. A multiple fracture producing apparatus for generating a fracture fluid pressure pulse and fracture fluid flow within a borehole penetrating a subsurface formation comprising:

tubing extending from the surface into said borehole, forming an annular-like space between said tube and said borehole;

a plenum for containing a pressurized fluid, said plenum attached to said tubing near one end of said tubing;

means for isolating a portion of said borehole containing said plenum from fluid communication with remaining portions; and means for rupturing said plenum when proximate to said borehole portion when said borehole portion contains a fracture fluid and said plenum contains a relatively high pressure pressurant, said rupturing means shaped and dimensioned to produce a fracture fluid pressure pulse and fracture fluid flow capable of producing multiple fractures within said formation.

13. The apparatus of claim 12 which also comprises first means for preventing backflow of said pressurized fluid towards said surface within said tubing.

14. The apparatus of claim 13 wherein said rupturing means comprises a plurality of burst diaphragms.

15. The apparatus of claim 14 wherein said plurality of burst diaphragms comprises a pressurant fluid circuit wherein at least one burst disc ruptures after the rupture of another burst disc and at least two burst discs rupture relatively simultaneously.

16. The apparatus of claim 15 wherein said isolating means comprises an expandable packer sealing dividing said annular-like space.

17. A method for producing a fluid pressure pulse in a cavity penetrating a material from a duct, said

18. The method f claim 17 wherein said plenum can be isolated from said fluid conduit.

* * * * *

UNITED STATES PATENT AND TRADEMARK OFFICE

CERTIFICATE OF CORRECTION

PATENT NO. : 5,005,649

DATED : April 9, 1991

INVENTOR(S) : John C. Smith and William O. Jacobson

It is certified that error appears in the above-identified patent and that said Letters Patent is hereby corrected as shown below:

Column 8, line 63, claim 17, add after "said" -- fluid pressure pulse sufficient to produce multiple fractures in said material, said method comprising:

a. placing at least a portion of said duct within said cavity, wherein said duct comprises a fluid conduit and a rupturable plenum containing a fluid;

b. pressurizing said fluid within said plenum from a remote pressurizing sourse; and c. rupturing said first plenum so as to cause said fluid pressure pulse. --

Signed and Sealed this

Twenty-fifth Day of August, 1992

*Attest:*

DOUGLAS B. COMER

*Attesting Officer*

*Acting Commissioner of Patents and Trademarks*